US005770814A

United States Patent [19]

Ealovega

[11] Patent Number: 5,770,814

[45] Date of Patent: Jun. 23, 1998

[54] FIRING RATE REGULATING MECHANISM

[75] Inventor: George D. Ealovega, Kennebunk, Me.

[73] Assignee: Defense Technologies Limited, Portland, Me.

[21] Appl. No.: 647,381

[22] Filed: May 9, 1996

[51] Int. Cl.[6] ..... F41A 19/04

[52] U.S. Cl. ..... 89/131

[58] Field of Search ..... 89/129.01, 131, 89/140, 141, 130, 143

[56] References Cited

U.S. PATENT DOCUMENTS

| | | | |
|---|---|---|---|
| 439,248 | 10/1890 | Maxim . | |
| 579,401 | 3/1897 | Maxim . | |
| 643,118 | 2/1900 | Garland . | |
| 1,511,262 | 10/1924 | Browning . | |
| 1,573,655 | 2/1926 | Sutter . | |
| 1,741,534 | 12/1929 | Pfeiffer | 89/131 |
| 1,895,719 | 1/1933 | Lahti . | |
| 2,035,303 | 3/1936 | Delacre . | |
| 2,182,907 | 12/1939 | Vollmer . | |
| 2,748,661 | 6/1956 | Simpson . | |
| 2,791,942 | 5/1957 | Fletcher | 89/131 |
| 2,873,650 | 2/1959 | Pinkerton, Jr. | 89/131 |
| 2,995,988 | 8/1961 | Reed . | |
| 3,650,177 | 3/1972 | Hupp et al. . | |
| 3,724,325 | 4/1973 | Silsby | 89/131 |
| 4,023,465 | 5/1977 | Inskip | 89/131 |
| 4,355,563 | 10/1982 | Swieskowski . | |
| 4,523,509 | 6/1985 | Thevis et al. | 89/129.02 |
| 5,379,677 | 1/1995 | Ealovega et al. . | |

FOREIGN PATENT DOCUMENTS

| | | |
|---|---|---|
| 591381 | 1/1934 | Germany . |
| 536995 | 6/1973 | Switzerland . |

*Primary Examiner*—Michael J. Carone
*Assistant Examiner*—Christopher K. Montgomery
*Attorney, Agent, or Firm*—Cesari and McKenna, LLP

[57] ABSTRACT

A firing rate regulating mechanism for an automatic firearm is provided. The firearm, typically, operates according to the closed bolt principle in which a moving bolt carrier carries a bolt that locks each cartridge in the chamber prior to firing. A moving firing pin and a hammer are provided to strike the cartridge's primer subsequent to locking of the bolt. A time delay unit is provided and is movable between a compressed position and an expanded position. Movement to the compressed position occurs at a first, relatively rapid rate while movement to the expanded position occurs at a second slower rate. A linkage is provided that compresses the time delay unit as the bolt carrier moves routinely and the hammer is retained against forward movement to strike the firing pin until the time delay unit has moved back into an expanded position. According to one embodiment, the time delay unit can be interconnected with an automatic sear that normally engages the hammer. The time delay unit, and its linkages, are interposed between the automatic sear and the bolt carrier, while the automatic sear is taken out of direct interconnection with the bolt carrier.

19 Claims, 12 Drawing Sheets

FIRING RATE REGULATING MECHANISM

FIELD OF INVENTION

This invention relates to a mechanism for regulating the rate of fire of fully automatic firearm.

BACKGROUND OF INVENTION

Automatic firearms have long experienced reduced accuracy in fully automatic fire mode. Even highly advanced firearms experience such reductions in accuracy when sustained bursts are unleashed. In the past, muzzle brakes, special stocks and other components have been added to machine guns, assault rifles and submachine guns in an effort to improve accuracy.

The primary source of inaccuracy in automatic firearms is vibration induced by a rapid succession of impulses as rounds are discharged in succession. Typically, the longer the burst, the more severe the vibration. Only through extensive training can a shooter learn to control the vibration of an automatic firearm to maintain desired accuracy. More often, the sustained burst causes the muzzle to climb or dance around so that only the first or second shot actually hit in the target area, and all successive shots are launched skyward.

The use of modem lightweight materials in the construction of advanced automatic firearms has only exacerbated the potential for degraded accuracy. While it is desirable to reduce the weight of a firearm so that it is easier to handle and carry, the reduction in weight makes it more susceptible to applied impulses, particularly from large rifle-size cartridges. As a result, modern lightweight automatic firearms are often very difficult to use without extensive training and many rounds are wasted at the range and in the field by the average shooter in an effort to acquire targets in full-automatic fire mode.

Many modern automatic firearms feature rates of fire in excess of 600–700 rounds per minute (RPM). It is recognized that such high cyclic rates of fire contribute significantly to inaccuracy. In addition, high rates of fire cause the shooter to waste ammunition. Only through extensive and costly training can a shooter become proficient with such a firearm. Even with adequate training, the shooter still finds the firearm marginally uncontrollable when firing sustained bursts.

Prior attempts to lower rates of fire have often involved the use of heavy bolts or long bolt recoil distances. However, these solutions only make the weapon heavier and larger, which is highly undesirable. Other complicated and bulky mechanisms have been employed in prior art designs to lower the rate of fire. However, these mechanisms suffer from reliability problems, and, undesirably add size and weight to the firearm.

A novel technique for regulating firing rate is disclosed in U.S. Pat. Nos. 5,379,677 and 5,485,776 to Ealovega, et al, the teachings of which are incorporated herein by reference. These patents recognize that the movement of the bolt of an automatic firearm can be interrupted for a predetermined period of time using either a hydraulic delay mechanism or a moving, electrically driven cam, respectively. The principles illustrated in these patents are applied to generally "open bolt" firearms. In an open bolt firearm, rounds are stripped from the magazine by the bolt and ignited by a firing pin prominently fixed in the bolthead. Ignition occurs just as the cartridge bottoms-out in the chamber. Subsequent to ignition, the bolt is driven rearwardly by the cartridge's impulse to a rearwardmost position. The delay mechanisms described in these patents engage the bolt in a rearward position and hold the bolt in this position until a predetermined delay time has expired. The bolt is then released to strip the next round from the magazine and fire it, in turn.

FIG. 1 details an alternative operating mechanism utilizing the "closed bolt" principle. In a closed bolt firearm, each cartridge is loaded into the chamber by the bolt before it is fired. In this example, the bolt assembly 30 and trigger mechanism 32 are utilized in the well-known M-16 family of automatic rifles. The principles illustrated are, however, applicable to a large variety of "closed bolt" firearms that are either recoil operated or gas operated.

The bolt assembly 30 includes a bolt carrier 34 that carries a rotating linearly movable bolt 36 having a series locking lugs 38. Within a recess of the bolt face 40 is provided a movable firing pin 43 that selectively projects under force in response to operation of a hammer 42 of the trigger mechanism 32. The hammer 42 shown in a fully extended position in phantom. It moves within the hollow center 45 of the bolt carrier 34 to engage the firing pin 43. Each time a cartridge is fired, gas is channeled to a gas key 44 that causes the bolt carrier to move rearwardly (arrow 46) against the force of a recoil spring 48 and buffer pilot 49. The bolt carrier 34 causes the hammer 42 to pivot rearwardly against the force of a hammer spring 56. After moving to a rearward most position, the spring 48 forces the bolt carrier 34 forwardly causing the bolt 36 to strip a cartridge 58 from the magazine 60 and to lock the cartridge 58 into the chamber 62. A bolt cam pin 64 engages an angled guideway to 66 force the bolt 36 to rotate as the bolt carrier 34 moves forwardly relative to the bolt in the final inch bolt carrier forward movement. This rotation causes the locking lugs 38 to lock behind the chamber lugs 68.

Because of the substantial power of the rifle cartridge 58 in this example, it is generally necessary to lock the bolt 36 relative to the chamber 62. Hence, unlike an open bolt weapon, ignition of the cartridge 58 should only occur after locking of the bolt 36 relative to the chamber 62. The forward pivotal motion of the hammer 42 is, thus, retarded by an automatic sear 70 that engages an automatic sear trip 72 of the hammer 42. The hammer, is, thus, held in a rearward position as the bolt carrier moves forwardly. Only when the sear is rotated by engagement between the sear's lever arm 74 and a forward trip surface 76 of the bolt carrier 34 is a hammer 42 allowed to fly forward against the firing pin 43. By this time, the bolt 36 is locked relative to the chamber 62 and cartridge ignition can safely occur. While there is a slight delay introduced by the automatic sear 70 ignition always occurs within milliseconds of the bolt carrier reaching its final position. Using a delay mechanism that retards the forward movement of the bolt according to the above-described prior patents is not desirable in a closed bolt system since the bolt carrier must be allowed to move forward to lock a cartridge into the chamber. However, the automatic sear trigger mechanism 32 of FIG. I immediately fires the next round as soon as the bolt carrier reaches its terminal position. Thus, a different technique for delaying firing must be provided.

The firearm illustrated in FIG. 1 is a "select-fire" weapon. It can be fired in either fully automatic or semi-automatic mode. The bolt carrier 34 always completes a full cycle of movement in either mode. Overall control of forward movement of the hammer 42 is provided by the trigger 53. By moving the trigger rearwardly (arrow 54) the trigger trip 55 is taken out of engagement with the hammer's lower shoulder 57. The hammer is, thus, free to move with respect to the trigger. In semi-automatic or "single shot" mode a disconnector 59 selectively engages an upper shoulder 61 of the hammer to prevent more than one shot from being fired. However, in automatic fire this disconnector 59 is disengaged by operation of the selector 63.

It is, therefore, an object of this invention to provide a firing rate regulating mechanism that can be employed on an automatic firearm operating according to the closed bolt principle. The regulating mechanism should be reliable, easy to service and adaptable to a variety of closed-bolt fire arms including submachine guns, automatic rifles, light machine guns and heavy machine guns. The mechanism should be usable in conjunction with select fire (e.g. semi-automatic and fully automatic) operation and should allow the firing rate to be "tuned" to the characteristics of a particular firearm. This mechanism should also be reliable, stable, compact and lightweight.

SUMMARY OF INVENTION

This invention overcomes the disadvantages of the prior art by providing a firing rate regulating mechanism that interfaces directly with the trigger mechanism of a closed bolt firearm to delay forward movement of the hammer into engagement with the firing pin until a predetermined time delay has elapsed. A compact, scaled, hydraulic time delay unit can be used to provide such a delay.

According to one embodiment, an automatic firearm includes a receiver having a bolt assembly that is movably mounted in the receiver. A firing pin is movably mounted in the bolt assembly. The bolt assembly can comprise a bolt having locking lugs and a bolt carrier. A hammer is provided in the receiver. It is movably mounted so that it can strike the firing pin when the bolt assembly is adjacent a forwardmost position. A first sear and a second sear are provided. The first sear can comprise a trigger sear and the second sear can comprise an automatic sear or a disconnector. Each sear is operatively connected to the hammer. The word "sear" as used herein can include any number of mechanisms that releaseably engage a moving, spring-loaded (typically), hammer. The first sear and the second sear release the hammer at predetermined times so that the hammer can move against the firing pin.

A time delay unit is further provided. It is operatively connected with at least the first sear or the second sear wherein movement of the bolt assembly causes the time delay unit to move to a first position in which at least one of the first sear or the second sear retain the hammer remote from the firing pin. The time delay unit is constructed and arranged to move to a second position after a predetermined time delay to subsequently operate the first sear or the second sear to release the hammer so that the hammer can move against the firing pin.

A moving cam is interconnected with the time delay unit in one embodiment. The cam moves the time delay unit to the first position in response to a rearward movement of the bolt assembly. The bolt carrier can include an engagement surface that actuates the cam. This engagement surface on the bolt carrier can be a ramp that also acts as a hammer engagement surface that causes the hammer to move in rearwardly to a position in which it is ready to strike the firing pin. The time delay unit, according to this embodiment, can comprise a scaled, spring-loaded hydraulic cylinder or another braking device that moves in a first direction at a first rate and that moves in a second, return direction, under force of a spring, at a second slower rate. The second slower rate provides the delay. The bolt carrier can be constructed and arranged to move rearwardly in response to expanding gas, recoil force, or another form of imparted energy.

The receiver can further include a third sear that comprises a disconnector that enables only one movement of the hammer each time the trigger is moved under pressure. A selector can be provided to the receiver for engaging and disengaging the disconnector. A transfer bar can be provided between the cam and the time delay unit. In this manner, the time delay unit can be located remote from the trigger mechanism in, for example, a stock or a grip of the firearm. The cam can be located relative to the first sear or the second sear so that a return movement of the cam, based upon movement of the time delay unit under spring force, causes the cam to bear upon the first sear or second sear, in turn, causing the first sear or second sear to release the hammer after a desired delay time has elapsed.

According to another embodiment of this invention, a method for modifying an automatic firearm to provide regulation of the rate of fire is provided. The method includes locating a time delay unit having a base and a movable part in which the movable part moves in a first direction at a first rate and moves in a second direction at a second slower rate with respect to the frame of the firearm. The movement in the second slower rate can occur under force of an internal spring of the time delay unit. A movable bolt engagement surface is provided. This engagement surface moves in response to movement of a predetermined portion of the bolt assembly thereover. The bolt engagement surface is interconnected with the time delay unit. The time delay unit is interconnected with the secondary sear. Such interconnection can be performed through the bolt engagement surface, itself. Alternatively, the interconnection can be performed by another part. Movement of the time delay unit, thus, selectively engages and disengages the secondary sear from the hammer whereby release of the hammer to move against the firing pin occurs, a predetermined time delay after movement of the bolt assembly to a predetermined position. Such movement of the time delay unit occurs in the second direction based upon the second, slower, rate of movement.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
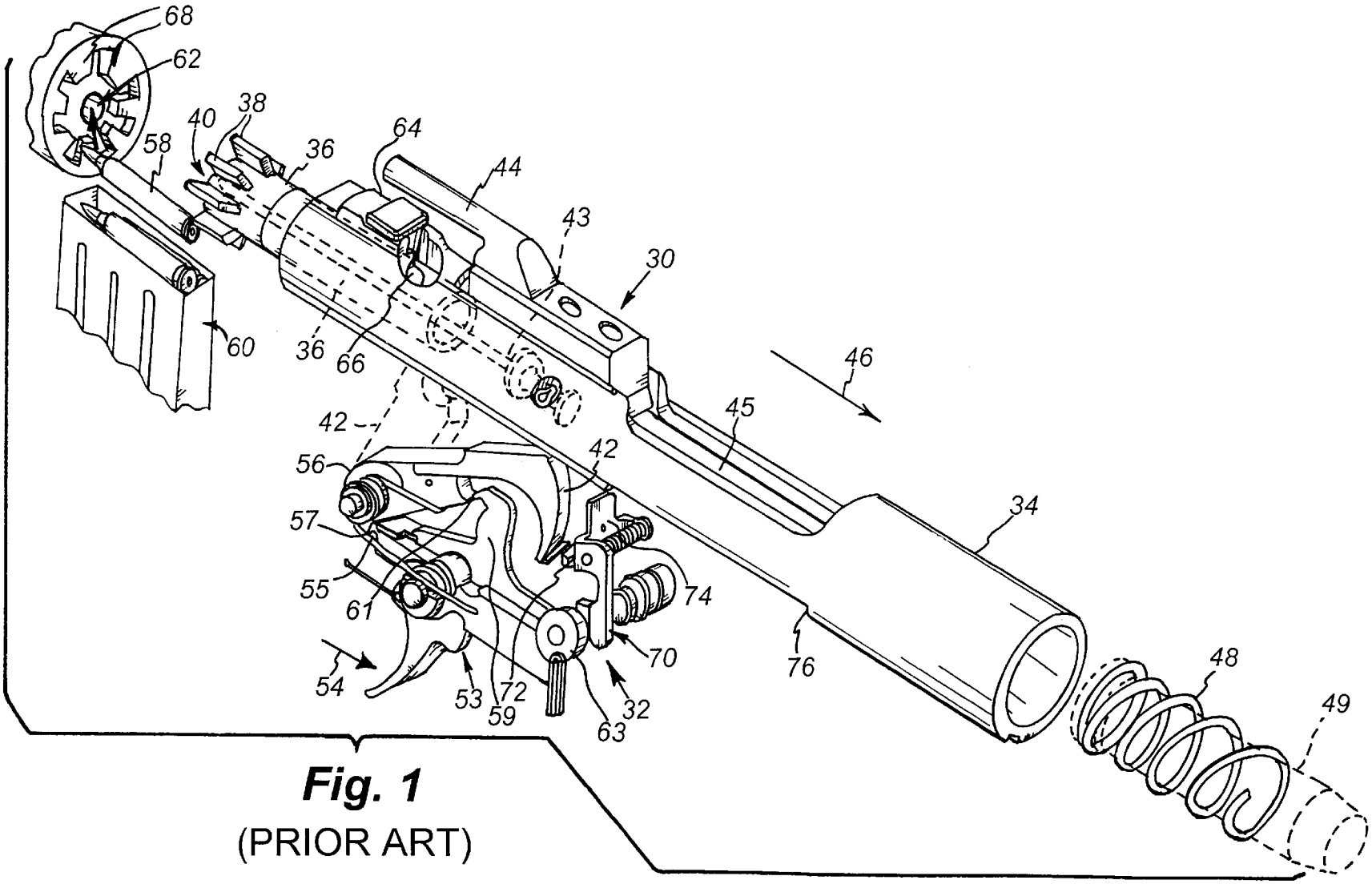
Fig. 1 (PRIOR ART)
FIG. 1 is a schematic partial perspective view of a closed bolt firing mechanism according to the prior art.

An automatic firearm incorporating a firing rate regulating mechanism according to a preferred embodiment of this invention is detailed in FIGS. 2, 3, 4 and 5. The firearm 100 is a modified version of the well-known M16-type automatic service rifle. This family of automatic rifles includes the newly developed M-4 Carbine produced by Colt Industries for the U.S. government. All versions of the M-16 family including certain non-U.S.-made derivatives, however, utilize a similar operating mechanism employing a closed-bolt action, as described with reference to FIG. 1. Accordingly, parts of FIGS. 2–5 that similar to those of FIG. 1 are denoted by like reference numerals. The various springs utilized in the trigger mechanism 102 have been omitted in FIGS. 2–5 for clarity, however, it should be assumed that springs similar to those described in FIG. 1 are present.

The trigger mechanism 102 is mounted in the lower receiver 104 which is shown schematically. The lower receiver 104 includes a base 106 for mounting the stock (not shown) which encloses a buffer tube 108 (FIG. 3). The buffer tube 108 houses and guides the recoil spring 48 and buffer pilot 49. In this embodiment, the upper receiver (not shown) is pivotally mounted at a point forward of the hammer 42 and the cartridge magazine 110 (shown in phantom in FIG. 2). A pin hole 112 is provided at the rear end of the lower receiver for retaining the upper receiver against the lower receiver. The upper receiver includes a cylindrical bore that guides forward (toward the chamber) and rearward (toward the stock) movement of the bolt carrier 120.

As noted above, the bolt carrier 120 moves forwardly and rearwardly relative the upper receiver to strip cartridges 58 from the magazine 110 and load them into the chamber for subsequent discharge. Discharge is effected by the firing pin 43 which moves forwardly to strike the cartridge primer in response to the forward pivotal movement of the hammer 42 under spring force. The bolt carrier 120, in this embodiment, is substantially similar to the unmodified carrier of FIG. 1. However, the automatic sear trip shoulder 76 of FIG. I has been moved rearwardly along the bolt carrier 120 by approximately 1 inch and a new modified shoulder 124 is provided. This new shoulder 124 provides clearance for the regulating mechanism cam 126 of this invention and no longer serves as a trip. The operation of the cam 126 is described below.

As further detailed in FIGS. 6, 7, 8 and 9, the automatic sear 128 of this embodiment has also been modified. The trip lever 74 of FIG. 1 has been removed (see removed trip lever shown in phantom in FIG. 9) so that the automatic sear 128 no longer engages the bolt carrier 120. Rather, the modified top shelf 130 of the automatic sear 128 now receives the front shoulder 132 of the cam 126. The cam 126 is mounted on a common axis pin 134 with the automatic sear 128. A raised surface or cylindrical "boss" 137 (FIGS. 7 and 8) can be formed on each side of the cam 126 to reduce wobble and provide a clearance spacing from the automatic sear 128. A portion of the automatic sear's spring 136 is removed (all but three wraps in this embodiment) to accommodate the cam 126 and its bosses 137. As detailed in FIG. 7, the cam is centered relative to the automatic sear and underlying lower receiver well (not shown). One boss 137 can be shorter than the other to provide clearance for the remaining portion of the automatic sear spring 136. In this manner, the bolt carrier 120 is aligned relative to the cam 126 in this embodiment. The cam 126 can be constructed from hardened steel and can have thickness (width w) of approximately 0.35 inch according to this embodiment. Narrower or thicker cams 126 are also expressly contemplated. The selector 63 is unchanged and, thus, the automatic sear 128 still responds to the selection of semi-automatic, safe, or fully automatic in the same manner as the prior art. Likewise, the disconnector 59 and trigger 53 still function according to the prior art. In FIGS. 2–5, the selector 63 has been set to fully automatic and, thus, the disconnector 59 is moved out of engagement with the disonnector shoulder 61 of the hammer 42 when the trigger 53 is pulled rearwardly (arrow 140). Likewise, with the selector moved to the automatic position, the automatic sear 128 is free to pivot into and out of engagement with the automatic sear shoulder 72 of the hammer 42 to delay forward movement of the hammer until the bolt carrier is moved forwardly to lock a cartridge 58 into the chamber.

The cam 126 is pivotally connected to a transfer bar 150 that extends downwardly into the grip assembly 152 in this embodiment. An appropriate hole can be provided in the lower receiver to allow the transfer bar 150 to extend into the grip assembly 152. The transfer bar 150 is pivotally connected at the opposing end to a yoke 154 that can be a flat piece or can define a u-shape with a pair of yoke legs 156. Each leg is pivotally connected by a common axis pin 158 to the grip assembly. The yoke 154 reinforces the linkage and can be omitted in some embodiments. The yoke 154 and transfer bar 150 are joined at a common axis pin 160 to the time delay unit 162 according to this invention.

Figure 14:
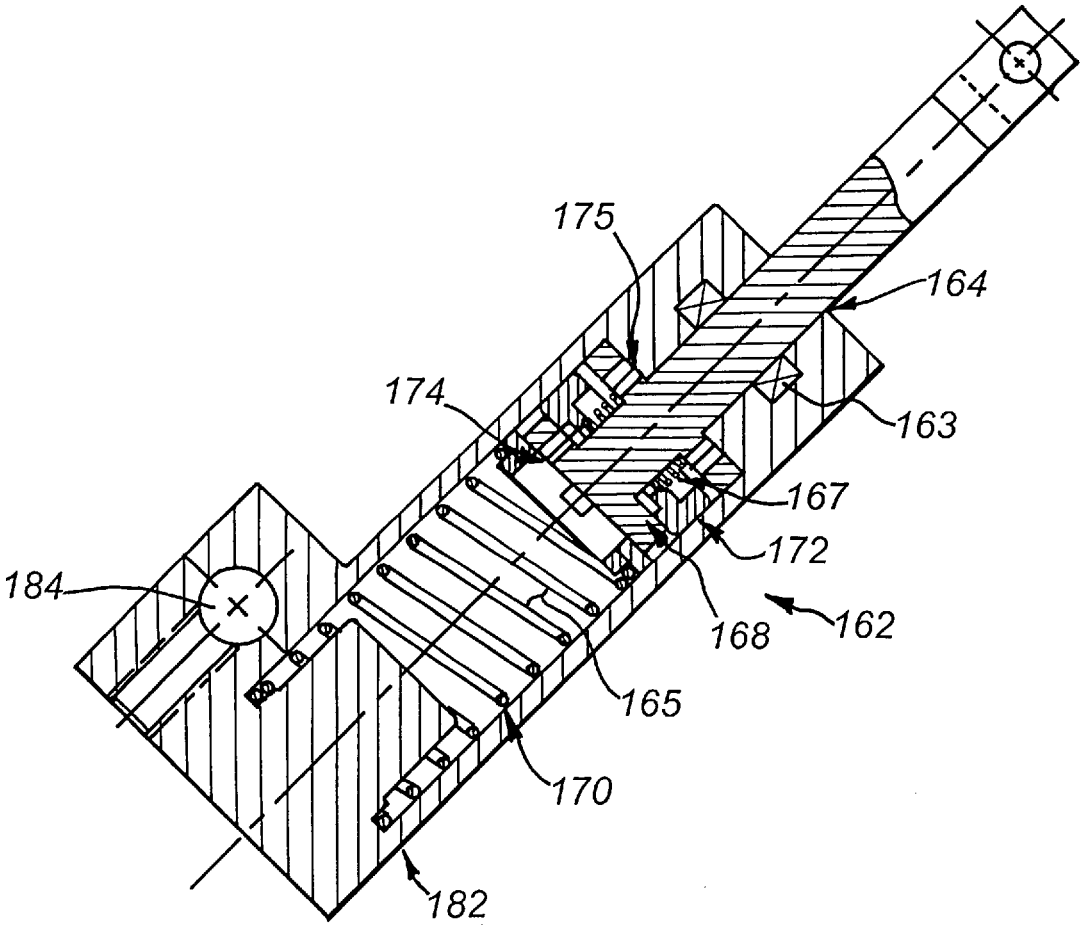
FIG. 14 is a schematic side cross section of a time delay unit according to an embodiment of this invention.

With further reference to FIG. 14, the time delay unit can comprise a hydraulic piston assembly 164 sealably located (seal 163) within a housing 166 that selectively allows hydraulic fluid 165 to pass through a piston 168. The piston 168 is biased upwardly by a spring 170. A spring-loaded (spring 167) check valve assembly 172 is provided so that upward movement of the piston 168 under force of the spring 170 occurs at a predetermined reduced rate. In one embodiment, a small return orifice 174 is provided in the piston 168 to resist movement of fluid from one side of the piston 168 to the other, thus slowing the rate of upward movement. The check valve 172 vents a large opening 175 on each down stroke of the piston 168 to enable rapid, low-resistance transfer of fluid for quick compression. But the check valve 172 closes off the large opening 175 for each up-stroke, insuring that only the small orifice 174 can transfer hydraulic fluid from one side of the piston 168 to the other generating increased resistance to movement. An appropriate time delay unit is available from the Enidine Incorporated in Orchard Park, New York. In one embodiment, a unit having Enidine Model No. SP-20341 can be used. The unit of this embodiment generates a time delay of approximately .04 seconds. It has an initial resistance force (preload) of approximately 6 lbs. with a maximum of approximately 10 lbs. at full compression. A stroke length of approximately 0.46 inch is used. It can operate stably in a temperature range of −40° F. to 150° F. and uses a low viscosity (approximately 100 centistokes) silicone-based hydraulic fluid available from Dow Corning Company. It is relatively compact with a housing length of approximately 2.4 inches and a housing diameter of approximately 0.75 inch. Clearly, the time delay unit of this invention is compact and lightweight. As used herein, the term "time delay unit," shall refer generally to a compact, self-contained mechanism approximately 2–4 inches in length or less and approximately an inch or less in width inches in length, and easily locatable in a conventionally shaped firearm with minimal alteration to the receiver or other parts. Such a "time delay unit" has a size that does not necessitate the construction of unwieldy protruberances on the firearm and should have a weight of no more than a few ounces, so as not to substantially increase the firearm's weight.

The delay produced by the time delay unit of this embodiment serves to lower the rate of fire of an M-4 carbine from approximately 850 rounds per minute to approximately 400 rounds per minute. Using a tactical sound suppressor, back-pressures can send the unregulated firing rate well above a thousand rounds per minute, and thus, the time delay unit lowers the rate proportionally, providing a manageable rate of fire. In both suppressed and unsurpassed operation, the regulated rate produced according to this invention provides optimum controllability while still providing a desired volume of fire for this model of firearm. As such, the time delay unit acts to "tune" the operation of the M-4/M-16.

Figure 2:
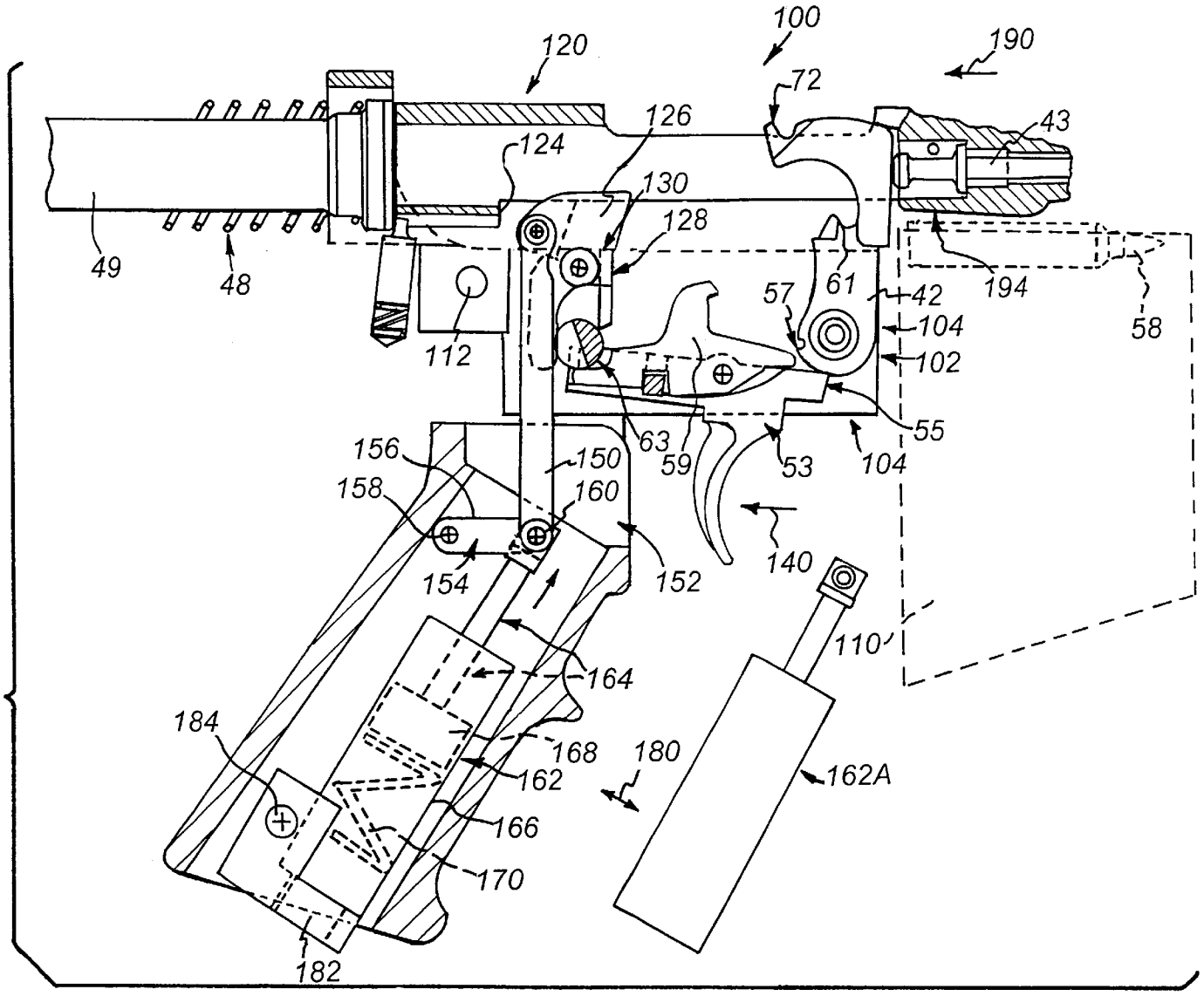
FIG. 2 is a schematic partial side cross section of an automatic firearm having a firing rate regulating mechanism according to an embodiment of this invention shown in a configuration just subsequent to firing.
Figure 3:
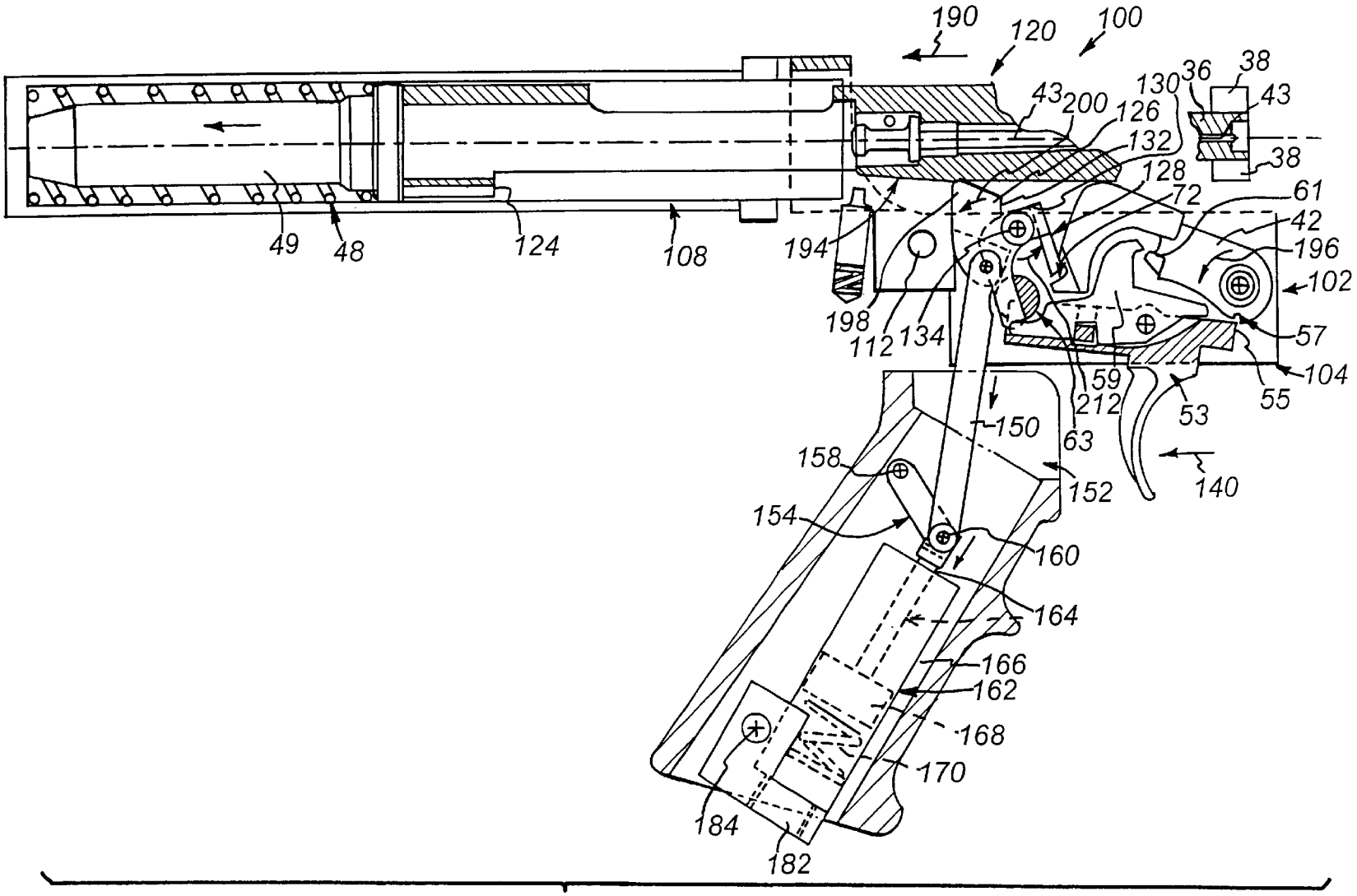
FIG. 3 is a schematic partial side cross section, the automatic firearm of FIG. 2 shown in a configuration in which the bolt assembly is moved fully rearwardly, ready to strip another cartridge from the magazine.

As illustrated in FIG. 2, a variety of delay time values can be provided by switching time delay units. For example, another time delay unit 162A can be substituted (double arrow 180) a removable base 182 having quick release pin 184 can enable rapid removal of the time delay unit 162 and substitution therefor for a similarly sized time delay unit 162A having a different delay rate on the return stroke. In addition, replacement units can be easily installed when a given time delay unit suffers failure. It is contemplated that the axis pin 160 at the end of the piston assembly 164 can also be quickly removable. It is specifically contemplated that a lug hole (see for example, FIGS. 10–13) can be provided directly to the cylindrical housing 166 or the time delay unit 162, 162A in a commercial embodiment. Note that the pin 184 also provides a pivot point for movement of the time delay unit 162 as the piston assembly 164 is stroked between expanded and compressed positions via the curved path of the yoke 154.

Referring again to FIGS. 2–5, the operation of the firing rate regulating mechanism according to this embodiment will now be described. FIG. 2 details the bolt carrier 120 position and trigger mechanism 102 orientation just after a round is discharged. The hammer 42 is fully forward and bearing upon the firing pin 43. Gas has been ported to the bolt carrier via the gas key (44 in FIG. 1) and the bolt assembly now begins its rearward movement (arrow 190). At this time, the piston assembly 164 of the time delay unit 162 is fully extended under force of its internal spring 170 causing the transfer bar 150 to pivot the cam 126 downwardly into engagement with the automatic sear shelf 130, causing the sear to pivot rearwardly out of engagement with the hammer shoulder 72.

In FIG. 3, the bolt carrier 120 has moved rearwardly (arrow 190) unlocking the bolt 36 from the chamber (62 in FIG. 1) and ejecting a spent shell casing from the upper receiver (not shown). A lower ramp 194 on the forward part of the bolt carrier 120 has caused the hammer to pivot rearwardly (curved arrow 196). The lower ramp 194, subsequently, catches the corner 198 of the cam 126 and causes the cam to pivot (curved arrow 200) rearwardly about the automatic sear axis pin 134. With the automatic sear upper shelf 130 free of the cam shoulder 132, the automatic sear can now pivot (curved arrow 202) under force of its spring (136 in FIG. 7) forwardly into engagement with the hammer's automatic sear shoulder 72. The hammer 42, is, thus, locked rearwardly until the automatic sear 128 is again disengaged. The rearward pivoting of the cam 126 causes the transfer bar 150 to move downwardly which, consequently, pushes the time delay unit's piston assembly 164 downwardly against the force of the time delay unit's internal spring 170. Since the unit's check valve 172 is open in this direction, downward movement of the piston assembly 164 occurs relatively quickly.

Figure 4:
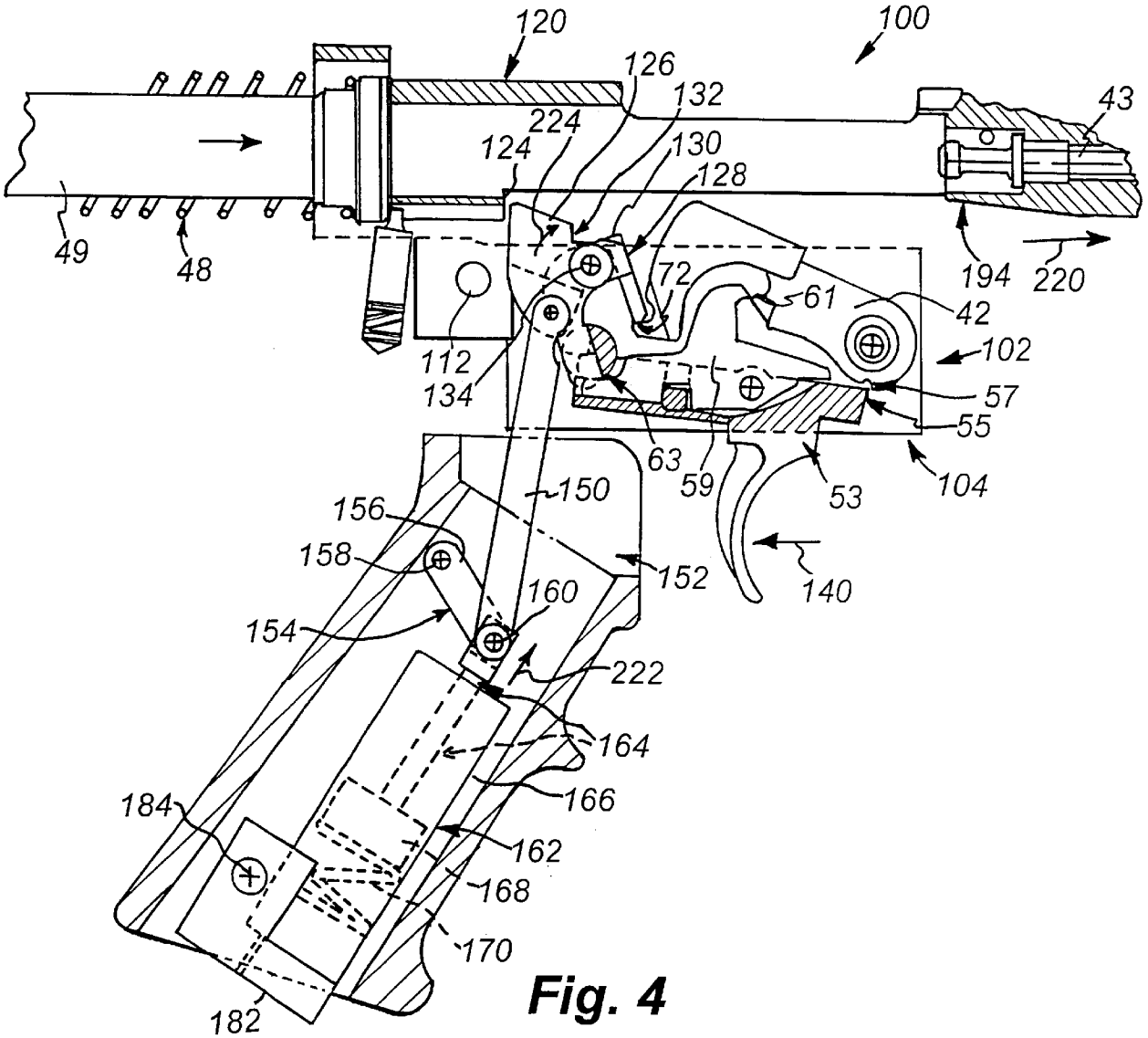
FIG. 4 is a schematic partial side cross section of the automatic firearm of FIG. 2 in a configuration in which the bolt assembly has locked another cartridge into the chamber and release of the hammer to fire the round is being delayed.

As shown in FIG. 4, the bolt carrier 120 now moves freely forwardly (arrow 220) under force of the buffer pilot 49 and recoil spring 48. A new cartridge is stripped from the magazine and locked into the chamber (not shown). Normally, the automatic sear 128 would be tripped by the bolt carrier at this position for relatively immediate discharge of a round. However, control of the automatic sear 128 is now provided by the cam 126. The time delay unit 162 operates so that the piston assembly 124 moves upwardly (arrow 222) more slowly causing the cam 126 to pivot (curved arrow 224) forwardly under force of the transfer bar 150. During the several milliseconds in which the cam 126 pivots forwardly, the automatic sear 128 continues to engage the hammer's automatic sear shoulder 72, preventing the hammer from falling onto the firing pin 43.

Figure 5:
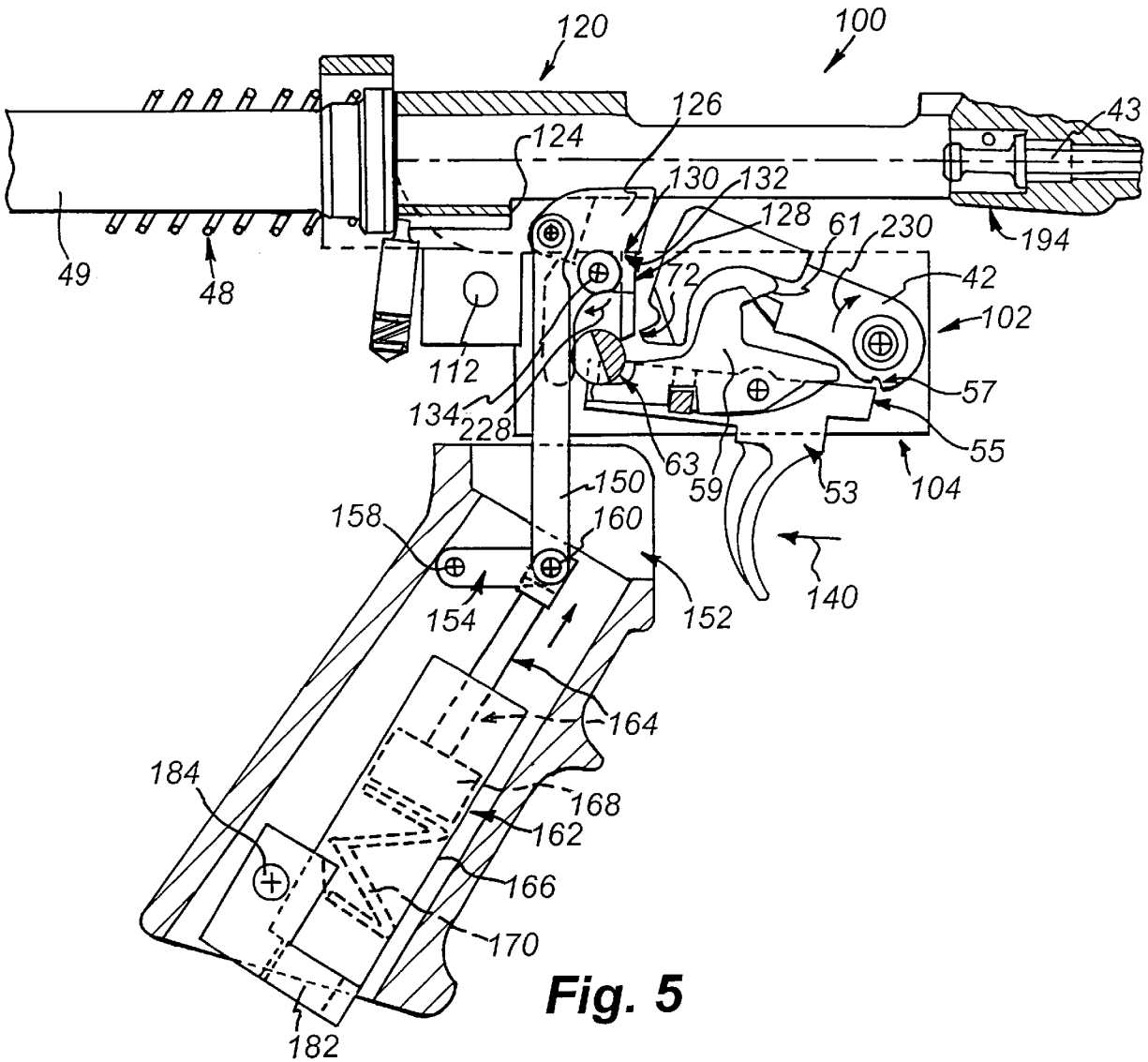
FIG. 5 is a schematic partial side cross section of the automatic firearm of FIG. 2 in a configuration in which the delay time has expired and firing is about to occur.
Figure 6:
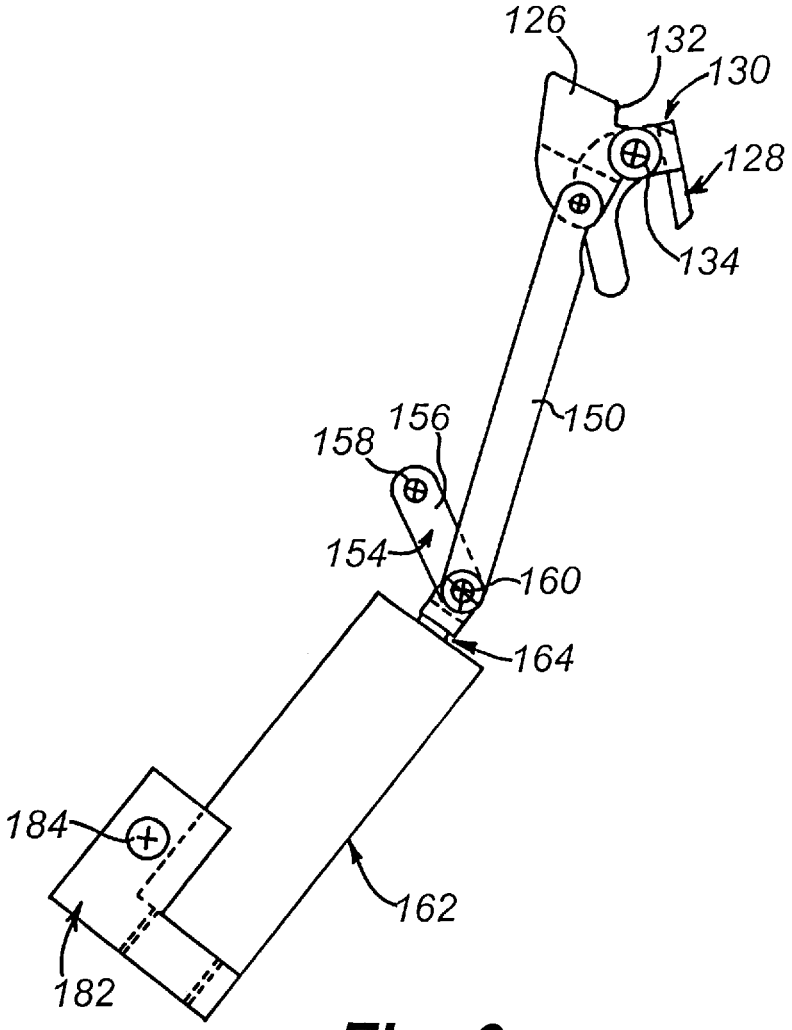
FIG. 6 is a schematic partial side view of the regulating mechanism according to the embodiment of FIG. 2.
Figure 7:
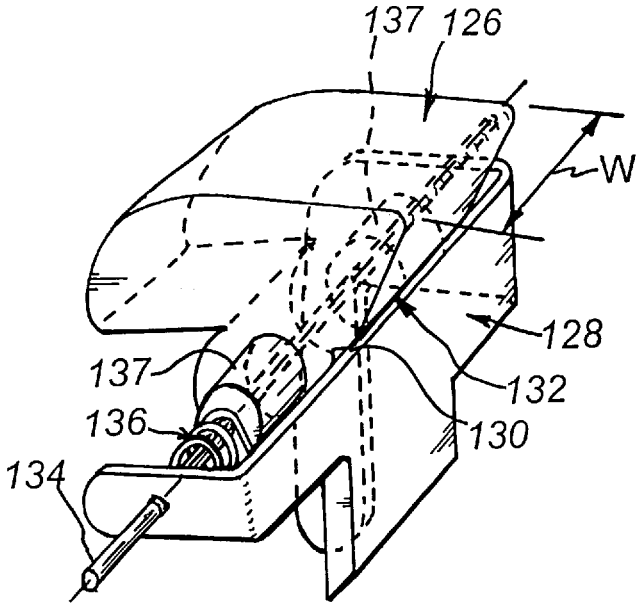
FIG. 7 is a schematic perspective view of the automatic sear and cam for the regulating mechanism of FIG. 6.
Figure 8:
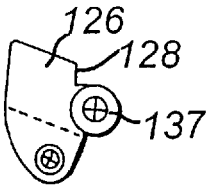
FIG. 8 is a schematic side view of the cam for the regulating mechanism of FIG. 6.
Figure 9:
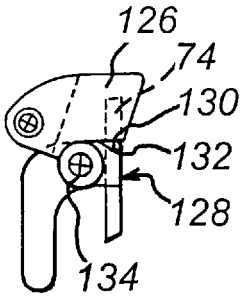
FIG. 9 is a schematic side view of the automatic sear and cam for the regulating mechanism of FIG. 6.

Finally, as shown in FIG. 5, the cam 126 has moved far enough forward so that its shoulder 132 engages the automatic sear upper shelf 130 causing the automatic sear 128 to pivot (curved arrow 228), moving the automatic sear out of engagement with the hammer's automatic sear shoulder 72. This disengagement occurs in the last fifty thousandths of an inch of travel of the cam 126 according to one embodiment. The hammer 42 is now free to swing forwardly (curved arrow 230) under force of its spring. At this time, the firing pin 43 is struck by the hammer, and a round is discharged. The process continues until all cartridges are exhausted or the trigger is relapsed, allowing the trigger sear 55 to engage the hammer's trigger sear notch 57. The resulting automatic fire achieved according to this embodiment is highly controllable, thus aiding in the rapid training of shooters and providing all shooters, regardless of level of competency, with an automatic firearm that is finely tuned to its particular handling characteristics.

It should be noted that additional resistance force to rearward travel of the bolt carrier 120 is provided by the cam 126. In one embodiment, approximately 6–7 extra pounds of recoil force is required to operate the firing rate regulating mechanism. Accordingly, it can be desirable to reduce the strength of the recoil spring 48 or preferably, to increase the force of the gas stroke applied to the bolt carrier 120. Increasing the force of the gas stroke in the M-16 family can be accomplished by opening the gas port (not shown) adjacent the end of the barrel. The exact size of the opening, can be determined generally by trial and error, opening the port incrementally until reliable cycling is obtained. The exact size of the opening is, typically, dependent upon the length of the barrel and specific model of firearm. In an M-4 Carbine configuration, an opening on the order of 20 thousandths of an inch can be provided.

The transfer bar 150 and yoke legs 154, as well as the cam 126 can be constructed from flat steel stock having sufficient strength and hardness to withstand the stresses of continued cyclic loading. As noted, hardened steel having a thickness between 1/16 inch and 1/8 inch can be used according to one embodiment other thickness' are expressly contemplated. Axis pins can be constructed from hard, tool-grade steel or similar long-wearing substance.

While the time delay unit 162 according to this embodiment is located in the grip assembly 152, is contemplated that the time delay unit 162 can be located in a variety of positions on the firearm. For example, according to an alternative embodiment (not shown) the time delay unit 162 can be provided beneath the buffer tube 108. A modified stock can be provided to receive the time delay unit.

It should be again noted that the firing rate regulating mechanism according to this embodiment does not affect the operation of the firearm on semi-automatic mode. The cam 126 will continue to bring the automatic sear 128 into and out of engagement with the automatic sear shoulder 72 of the hammer 42, but the disconnector 59 will actively limit forward movement of the hammer after each shot, until the trigger is released. In this embodiment, the delay is typically short enough in time duration such that the cam 126 moves through a full cycle of operation before a release of the trigger can occur. Using a slower time delay unit, it is possible to provide a firearm in which semi-automatic mode also experiences a noticeable delay, if the next shot is fired too quickly. In such an embodiment, it is desirable to locate the disconnector shoulder 61 so that the disconnector cannot be reengaged after an initial release of the trigger. Rather, the hammer moves upward slightly to, then, engage the automatic sear. Otherwise, it is possible that two releases of the trigger will be necessary to fire semi-automatically. Similarly, it is contemplated that the firing rate regulating mechanism of this embodiment can be used in conjunction with a burst-limiting mechanism, such as a cam wheel, as currently employed in certain models of the M-16 family. However, such a burst-limiting feature may be unnecessary due to the increased accuracy and slower firing rate of the firearm according to this invention.

While the preceding embodiment has been directed, particularly to the M-16 family, the concepts described herein are applicable to a wide-range of firearms utilizing the closed-bolt technique. Common to all is the utilization of two separate locking mechanisms to prevent forward movement of the hammer. The first locking mechanism is actuated by the trigger, while the second locking mechanism is actuated by the time delay unit of this invention. Engagement of these two locking mechanisms with the hammer can be accomplished using sears that selectively bear upon shoulders of the hammer or other similar linkages can be employed. For example, the time delay unit can be connected directly to the disconnector 59 and the automatic sear can be omitted according to an alternate embodiment. Such configuration is expressly contemplated.

Figure 10:
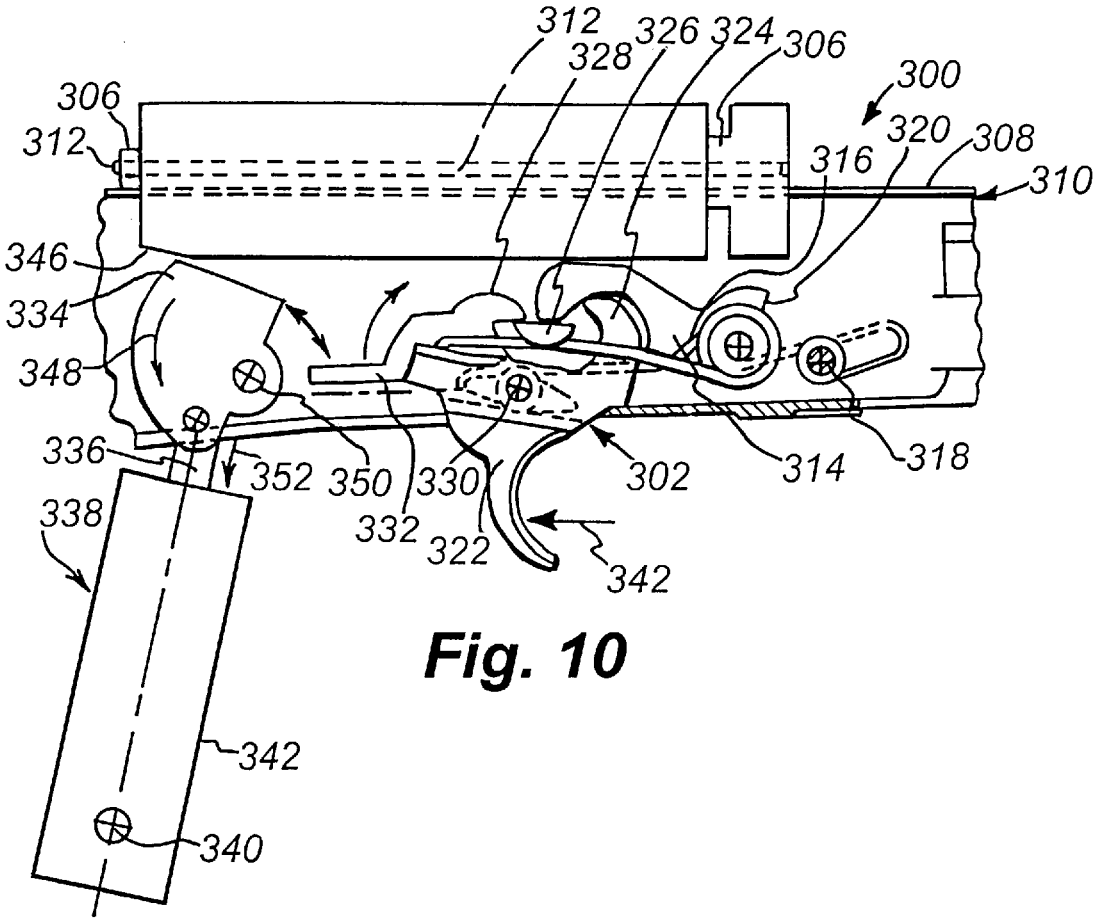
FIG. 10 is a schematic partial side cross section of an automatic firearm having a firing rate regulating mechanism according to an alternate embodiment, operating at a first time.
Figure 11:
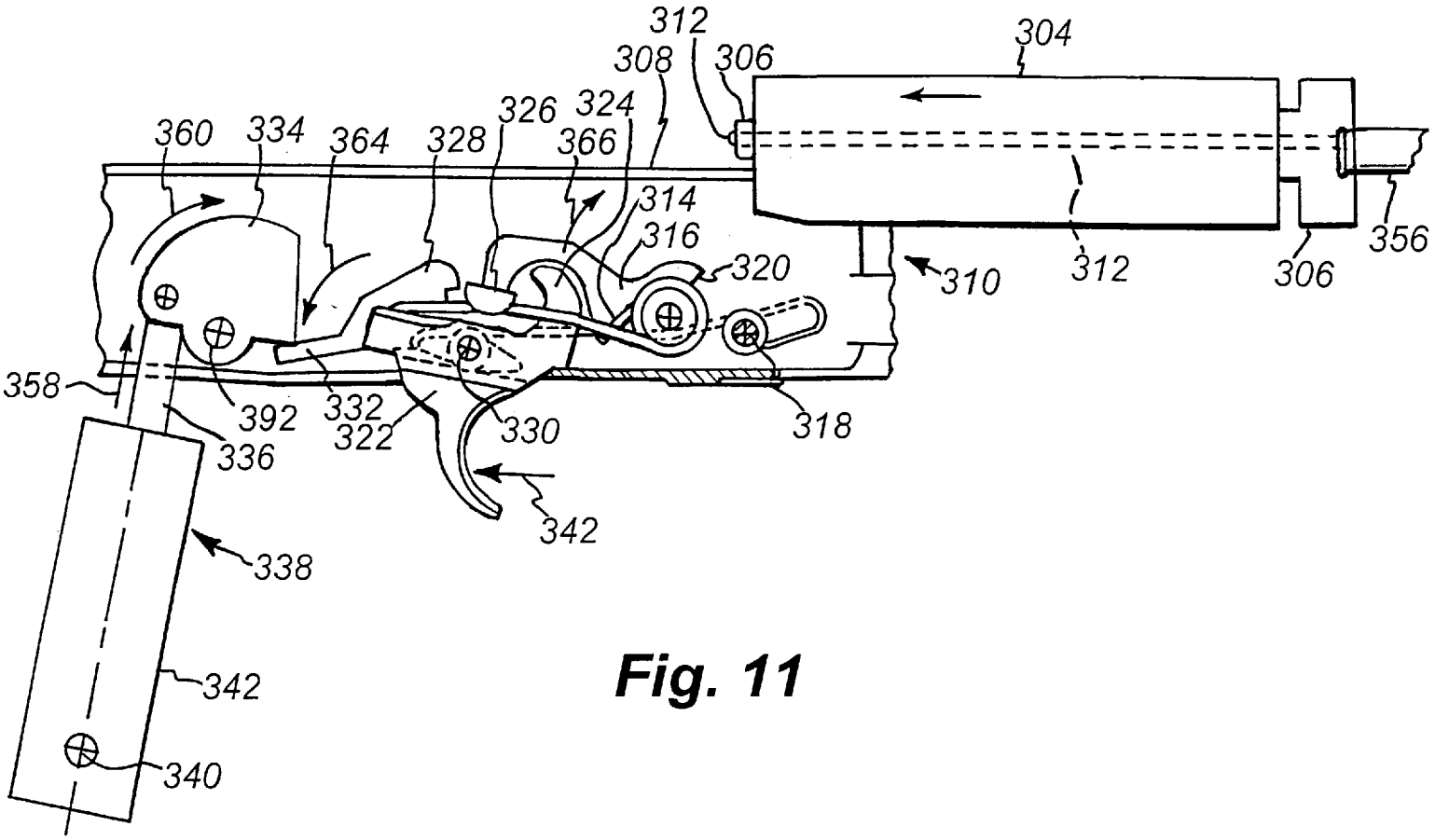
FIG. 11 is a schematic partial side cross section of the automatic firearm of FIG. 10, operating at a second time.

FIGS. 10 and 11 illustrate an alternate mechanism for providing firing rate regulation to an automatic firearm. The depicted firearm 300 utilizes a trigger mechanism 302 styled on the Kalishnikov system. A bolt carrier 304 having a moving bolt 306 that lockably engages the chamber (not shown) rides along a rail 308 formed within the receiver 310. A floating firing pin 312 is positioned at a rear end of the bolt 306. When the bolt carrier 304 is in a forwardmost, locked position, the firing pin 312 is located to be struck by a hammer 314 that pivots forwardly under force of a spring 316. According to the prior art, an automatic sear positioned on the frontmost axis pin 318 has been removed. This automatic sear, normally engages the bolt carrier 304 adjacent its forwardmost position, thereby disengaging the automatic sear shoulder 320 of the hammer 314, allowing the hammer to pivot forwardly to strike the firing pin 312. As detailed in FIGS. 10 and 11 the trigger 322 includes a hammer hold-down sear 324 that engages a shoulder 326 on the hammer 412. The same shoulder also selectively engages a disconnector 328. The disconnector is normally biased forwardly about the trigger axis pin 330. In normal automatic mode, the prior art utilizes a selector that disengages the disconnector. However, this form of selector has been removed and the disconnector 328 now serves as part of the rate regulating mechanism according to this embodiment. An extended disconnector leg 332 extends rearwardly from the disconnector 328 so that it projects into the rotational path of a cam 334 according to this embodiment. The cam is interconnected with the piston assembly 336 of the time delay unit 338 of this embodiment. The time delay unit 338 is located adjacent the grip in this embodiment, however, it can be positioned directly in the receiver 310 or at another location upon the firearm. Note that a lug hole 340 is provided directly within the housing 342 of the time delay unit 338.

FIG. 10 illustrates action of the firearm 300 subsequent to discharge of a round. Note that the trigger remains pulled (arrow 342) so that further rounds are discharged automatically. The bolt carrier 304 has moved rearwardly, causing the hammer 314 to move backward into engagement with the disconnector 328. The bolt carrier 304 has continued to move rearwardly until its rear ramp 346 causes the cam 334 to pivot (curved arrow 348) rearwardly about its axis 350. This pivotal motion of the cam 334 causes the piston assembly 336 of the time delay unit 338 to move downwardly (arrow 352) against the force of its internal spring (not shown).

As further detailed in FIG. 11, the bolt carrier 304 has now moved forwardly, locking a new cartridge 356 in the chamber (not shown). After a predetermined delay, the piston assembly 336 has moved upwardly (arrow 358) a sufficient distance to cause the cam 334 to pivot (curved arrow 360) into engagement with the disconnector leg 332. The disconnector 328 is, thus, pivoted (curved arrow 364) about the trigger axis 330 out of engagement with the hammer shoulder 326 and the hammer is free to pivot forwardly (curved arrow 366) to strike the firing pin 312. The operation continues until the trigger 322 is released, enabling the hold-down 324 to engage the hammer shoulder 326. Note that a selector can be provided. Such a selector could operate to break the interconnection between the cam 334 and the disconnector leg 332, allowing the disconnector to engage the hammer after each shot. Only after the trigger is released, would the shoulders 326 break engagement with the disconnector 328 and fall into engagement with the hold down 324.

Figure 12:
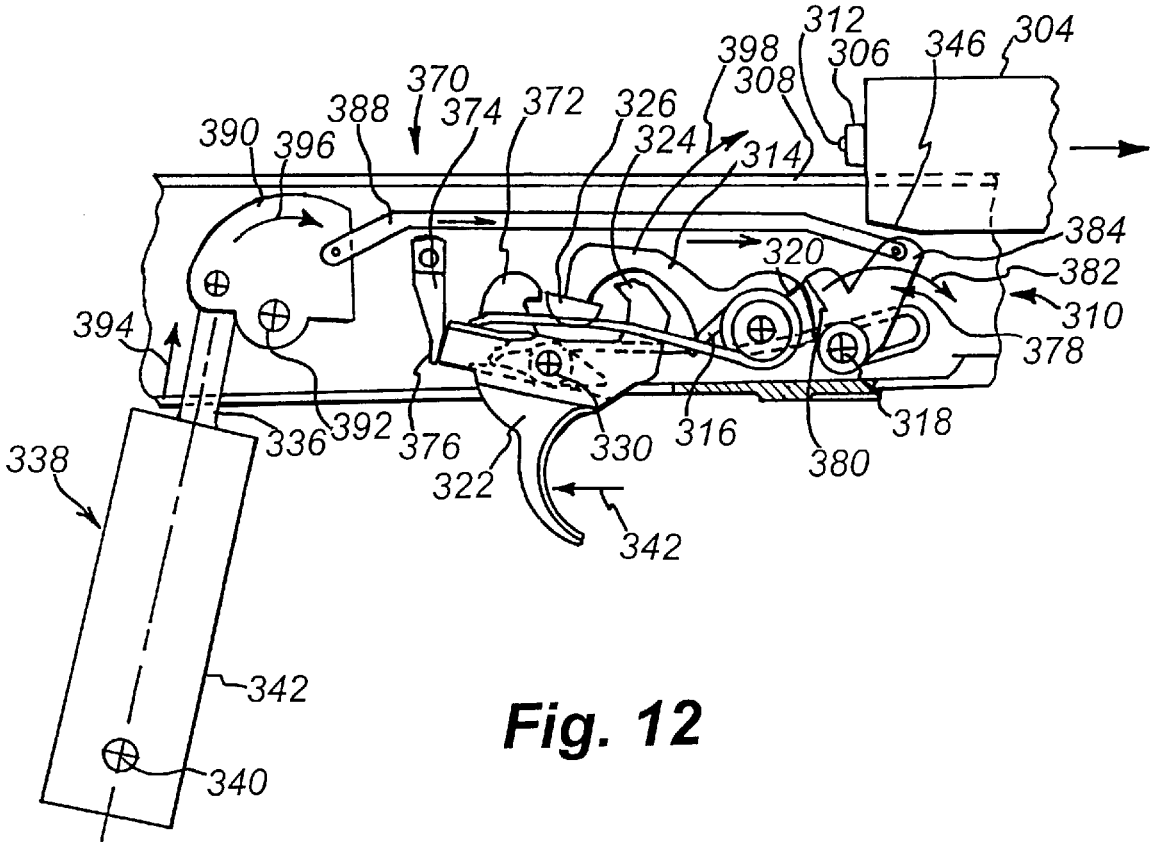
FIG. 12 is a schematic partial side cross section of the automatic firearm of FIG. 10 having a firing rate regulator mechanism according to an alternate embodiment.

FIG. 12 illustrates an alternate embodiment of a Kalishnikov-style automatic firearm 370 having a conventional receiver 310. Components that are like those described with reference to FIGS. 10 and 11 are like numbered. This embodiment utilizes a conventional disconnector 372 that can be engaged and disengaged in response to a rotatable selector 374. A shortened disconnector leg 376 is provided. This leg 376 is engaged by the selector 374 during fully automatic operation to move the disconnector 372 away from the shoulder 326 of the hammer 314 as the trigger is pulled. The selector is disengaged from the shortened leg 376 during semiautomatic operation, allowing the disconnector 372 to engage the shoulder 326 at the hammer 314 after each shot. An automatic sear 378 is also provided. The automatic sear includes an automatic sear shoulder 380 located to engage the automatic sear shoulder 320 of the hammer 314. The sear 378 is pivotally mounted (arrow 382) on the sear axis 318. Unlike the prior art automatic sear, the automatic sear 378 of this embodiment includes a shortened lever arm 384 that is located out of contact with the bolt carrier 304. According to the prior art, the bolt carrier includes a sear engagement catch. This catch has been removed and/or the sear has been shortened to avoid the catch in the present embodiment. Appropriate grooves can be formed in the bolt carrier 304 to enable movement of the bolt carrier over the sear without interference. The lever arm 384 of the automatic sear 378 is pivotally connected to a transfer bar 388. The transfer bar can be located so that it is out of interfering contact with the various components of the firing mechanism and so that the bolt carrier passes over it without interference. It should be clear that the transfer bar can be located at any position within the receiver 310 so long as it transfers force linearly between the cam 390 and the lever arm 384 of the automatic sear 378. The cam 390, like that described with reference to FIGS. 10 and 11, moves pivotally on an axis 392 so that it is engaged by a rear ramp 346 of the bolt carrier 304. Rearward movement of the bolt carrier 304 causes the cam 390 to pivot rearwardly causing the piston assembly 336 to compress. As shown in FIG. 12, the piston assembly 336 moves upwardly under (arrow 394) under a delay causing the cam 390 to pivot forwardly (curved arrow 396), moving the sear lever arm 384 forwardly. Forward movement of the sear lever arm causes a corresponding pivotal motion (curved arrow 382) in the sear, bring the outer sear shoulder 380 out of engagement with the auto sear shoulder 320 of the hammer 314. The hammer is now free to pivot forwardly (curved arrow 398),allowing the hammer to strike the firing pin 312.

Like the M-16 embodiment described previously, the Kalishnikov-type action or other similar actions, may require modification of the recoil spring and/or gas system to provide additional recoil force necessary to overcome the cam and time delay unit. The extent of such modifications are dependent on the type of firearm and can be made incrementally (e.g. boring or cutting) on a trial-error basis until appropriate functioning is obtained.

Figure 13:
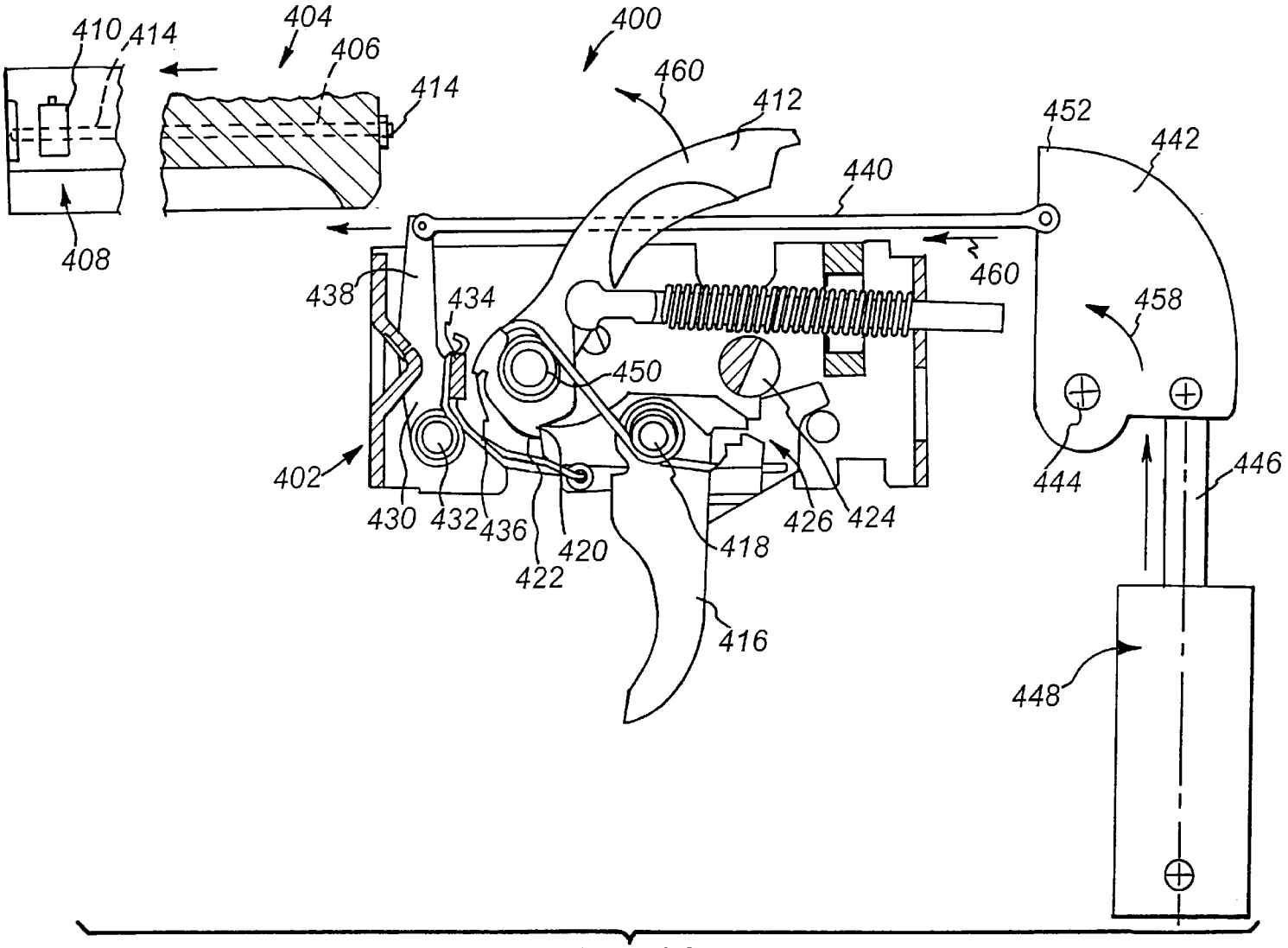
FIG. 13 is a schematic partial side cross section of a firearm having a firing rate regulating mechanism according to yet another alternate embodiment.

Another embodiment utilizing the rate regulating mechanism of this invention is illustrated in FIG. 13. A firearm 400 having a trigger mechanism 402 patterned on the Heckler and Koch/CETME system is featured. The bolt assembly 404 includes a bolt carrier 406 and bolt head 408 that operates on a delayed blowback principle, also known as recoil operation. Roller bearings 410 in the bolt head 408 engage conforming recesses in the chamber (not shown) delaying rearward travel of the bolt head until cartridge pressures have reduced. The bolt head 408 is then unlocked and the bolt assembly 404 moves rearwardly to override the hammer 412. A movable firing pin 414 is struck by the hammer 412 after the bolt head locks a cartridge into the chamber. The trigger 416 pivots about an axis 418. A trigger sear 420 can be brought into and out of engagement with a trigger sear shoulder 422 of the hammer. As detailed, the trigger 416 has locked the hammer 412 in a non-firing position. The selector 424 is shown in fully automatic mode, disengaging the disconnector assembly 426, which remains unaltered in this embodiment. A modified automatic sear 430 is provided. The automatic sear 430 pivots about an axis 432. The sear 430 includes an automatic sear shoulder 434 that engages a corresponding automatic sear shoulder 436 on the front of the hammer 412. The automatic sear 430 of this embodiment includes a lever arm 438 that is free of engagement with the bolt carrier 406. According to the prior art, a trip lever engages the automatic sear to move it forwardly when the bolt carrier has moved forwardly to lock a cartridge into the chamber. This trip lever has been omitted and the automatic sear is disengaged from the bolt carrier. Conversely, a transfer bar 440 is pivotally connected to the lever arm 438 of the automatic sear 430. An opposing end of the transfer bar 440 is pivotally connected to a cam 442 according to this embodiment. The cam is pivotally mounted about an axis of 444 and interconnected with the piston assembly 446 of a time delay unit 448. The amount of delay provided by the time delay unit in this and other embodiments described herein can be set based upon the inherent, non-regulated rate of fire of the firearm and the desired optimal firing rate.

In operation, as a round is discharged, the bolt carrier 406 moves rearwardly, passing over the hammer 412, causing it to pivot rearwardly against the force of its hammer spring 450. As the bolt carrier 406 continues its rearward movement, it retains the hammer 412 in a downward position while engaging the corner 452 of the cam 442. The cam 442 is pivoted rearwardly about its axis 444, moving the automatic sear 430 rearwardly about its own axis 432 until the automatic sear shoulder 434 engages the shoulder 436 of the hammer. The cam 442 simultaneously compresses the piston 446 of the time delay unit 448. The bolt carrier 406 moves quickly forward, chambering the next cartridge while the delay unit holds the cam 442 back and only allows it to pivot forward slowly under a predetermined delay. Once the cam 442 has pivoted forwardly (curved arrow 458) a sufficient distance, the transfer arm 440 forces the automatic sear forwardly (arrow 460), out of engagement with the hammer 412. The hammer 412 is now free to pivot forwardly (curved arrow 460) to strike the firing pin 414. As noted above, the action is shown in FIG. 13 with the trigger 416 released (e.g. non-firing). However, when the trigger is pulled, the delay cycle will follow automatically after each expended round. As in the other embodiments described herein, the firing rate regulating mechanism of this embodiment is applicable to variety of automatic firearm. For example, the Heckler and Koch system is utilized, almost identically in a wide range of models. The system described herein is applicable, therefore, to the MP–5 submachine gun chambered in 9-millimeter, 10-millimeter and other pistol calibers, the HK 23light machine gun, the HK33,HK53 and G- 41 assault rifles, chambered in 5.56 millimeter and the HK21 light machine gun and HK G-3 assault rifle chambered in 7.62 millimeter. This is only a partial listing, however. Similarly, the principles described with reference to the M-16 are also applicable to submachine gun versions of the M-16 such as the Colt 9-millimeter Carbine. It should be noted that the Colt 9-millimeter includes a non-locking bolt assembly in which the bolt head is fixed relative to the carrier. A separate hammer and floating firing pin are still utilized and firing occurs from a "closed bolt" position with straight-blowback recoil operation. Hence, as used herein, the term "bolt assembly" shall be taken to include a non-locking bolt that is fixed relative to a carrier or a single "bolt" without a carrier, so long as a separately movable firing pin is employed. As noted above, modifications to the recoil system can be desirable to ensure sufficient recoil force to activate the cam and time delay unit.

As also discussed above, the position of the time delay unit 448 can be varied depending upon the type of firearm. The time delay unit 448 can be located in the grip assembly, for example. Conversely, the time delay unit can be positioned in the stock, or elsewhere. The shape of the cam and the location of the pivot points should be set to optimize operation for a given positioning of a time delay unit.

While the time delay unit described herein is a hydraulic piston, it is contemplated that other types of time delay units can be employed according to this invention. For example, a unit that operates on gas pressure or friction can be substituted. As used herein, the term "time delay unit" shall be taken to include any "braking device" that provides a settable/extended recovery time after an initial actuation before it returns to a given position. It is contemplated that this "recovery time" is generally greater than the time attributable to movement of the trigger mechanism without such a time delay and that the recovery time is, preferably, selectable by selecting an appropriate time delay unit. It is also contemplated that the time delay unit can include an internal brake or other device that enables internal variation of the time delay within a predetermined range of delay times. In this manner, a variable rate of fire can be provided to a given firearm.

The foregoing has been a detailed description of several embodiments of the invention. Various modifications and additions can be made without departing from the spirit and scope of the invention. For example, the principles provided herein can be applied to non-hand held or mounted automatic firearms and to large calibers weapons such as automatic cannons. Similarly, the firing rate regulating principles described herein are applicable to a variety of recoil systems other than those described herein, including a straight-blowback system without bolt lock-up.

Additionally, while the time delay unit is shown with the piston assembly interconnected to the cam and the base fixed to the firearm, it is contemplated that the piston assembly can be interconnected with the base of the firearm and that the base of the time delay unit can be interconnected with the cam so that the housing of the time delay unit is movable. Finally, while a cam is detailed herein, a variety of movable surfaces can be substituted. It is expressly contemplated that other time delay unit-actuating members can be employed, such as lever arms, pressure plates or plungers that respond to a predetermined movement of the bolt assembly. Appropriate linkages can be provided between such actuating members in the time delay unit and, similarly, between the time delay unit and the trigger mechanism to interrupt movement of the hammer. Accordingly, this description is to be taken only by way of example and not to otherwise limit the scope of the invention.

What is claimed is:

1. An automatic firearm comprising:

a receiver;

a bolt assembly movably mounted in the receiver and a firing pin movably mounted in the bolt assembly;

a hammer movably mounted in the receiver, constructed and arranged to move against the firing pin when the bolt assembly is adjacent a forwardmost position;

a first sear and a second sear each operatively connected to the hammer to release the hammer at predetermined times so that the hammer can move against the firing pin, at least one of the first sear and the second sear being interconnected with a trigger;

a time delay unit operatively connected with at least one of the first sear and the second sear wherein movement of the bolt assembly causes the time delay unit to move to a first position in which at least one of the first sear and the second sear retain the hammer remote from the firing pin and wherein the time delay unit is constructed and arranged to move to a second position after a predetermined delay time to operate at least one of the first sear and the second sear to release the hammer so that the hammer moves against the firing pin; and a time delay unit actuator including a cam pivotally mounted on the frame that engages the bolt assembly upon rearward movement of the bolt assembly and a linkage that transfers movement of the cam into movement of the time delay unit.

2. The automatic firearm as set forth in claim 1 wherein the bolt assembly comprises a bolt carrier and a bolt head movably mounted relative to the bolt carrier and wherein the bolt carrier includes an engagement surface for actuating the time delay unit upon movement of the bolt carrier.

3. The automatic firearm set forth in claim 2 wherein the first sear comprises a trigger sear interconnected with the hammer and the second sear comprises an automatic sear also interconnected with the hammer at a location on the hammer remote from the trigger sear.

4. The automatic firearm set forth in claim 2 wherein the time delay unit comprises a spring-loaded hydraulic cylinder movable in a first direction at a first rate and movable in a second, return direction, under force of a spring, at a second slower rate.

5. The automatic firearm set forth in claim 2 wherein the bolt carrier is constructed and arranged to move rearwardly in response to expanding gas.

6. The automatic firearm set forth in claim 5 wherein the bolt carrier is constructed and arranged to move rearwardly in response to recoil force imparted by a cartridge.

7. The automatic firearm set forth in claim 1 further comprising a disconnector constructed and arranged to engage the hammer at predetermined times, the disconnector being operatively connected to the trigger and disengaging from the hammer in response to a removal of pressure from the trigger whereby the disconnector enables only one movement of the hammer each time the trigger is moved under pressure.

8. The automatic firearm set forth in claim 7 further comprising a selector movable between a position in which the disconnector is engageable with the hammer in a position in which the disconnector is continuously disengaged from the hammer.

9. The automatic firearm set forth in claim 1 wherein the linkage comprises a transfer bar that moves approximately linearly in response to pivotal movement of the cam.

10. The automatic firearm set forth in claim 9 wherein the time delay unit comprises a linear braking device having a free end pivotally mounted to the transfer bar and having a base fixedly mounted to the frame.

11. The automatic firearm set forth in claim 10 further comprising a yoke located adjacent at end of the transfer bar opposite the cam and pivotally mounted to the transfer bar.

12. The automatic firearm set forth in claim 11 wherein the braking device comprises a hydraulic cylinder and a piston assembly, the piston being spring-loaded to expand relatively to the cylinder and being compressible at a first rate and expanding at a second slower rate.

13. The automatic firearm as set forth in claim 1 wherein the first sear comprises a trigger sear and the second sear comprises an automatic sear pivotally mounted relatively to the frame on an axis and movable into and out of engagement with the hammer and wherein the cam is pivotally mounted on the axis and operatively interconnected with the time delay unit so that movement of the bolt assembly in a rearward direction causes the cam to move the time delay unit to the first position wherein the cam is movable to engage the automatic sear and move the automatic sear, thereby, out of engagement with the hammer subsequent to the predetermined delay time upon movement of the time delay unit to the second position.

14. A method for modifying an automatic firearm to provide regulation of a rate of fire of the firearm, the firearm having a frame, a barrel, a bolt assembly that moves along the frame in a forward direction toward the barrel and in a rearward direction away from the barrel, the bolt assembly including a moving firing pin, a hammer constructed and arranged to move against the firing pin when the bolt assembly is adjacent a forwardmost position against the barrel, a trigger sear and a secondary sear that selectively engages and disengages the hammer to, respectively, retain the hammer against movement against the firing pin and to cause the hammer to move against the firing pin, the method comprising the steps of:

locating a time delay unit comprising a hydraulic cylinder and a piston assembly and having a base and a movable part wherein the movable part moves with respect to the frame of the firearm in a first direction at a first rate and moves in a second direction at a second rate that is slower than the first rate, a movement of the movable part in the second direction being responsive to a spring that biases the movable part away from the base and wherein the spring is compressed by movement of the movable part in the first direction; mounting in the frame a movable bolt engagement surface that moves in response to movement of a predetermined portion of the bolt assembly thereover in the rearward direction from an interfering position within a path of movement of the bolt assembly to a non-interfering position remote from the path of movement of the bolt assembly;

interconnecting the bolt engagement surface with the time delay unit so that movement of the predetermined portion of the bolt assembly in the rearward direction to, thereby, move the bolt engagement surface to the position remote from the path of travel of the bolt assembly causes the time delay unit to move in the first direction, the time delay unit moving in the second direction to, thereby, move the bolt engagement surface into the imterfering position when the bolt assembly subsequently moves in the forward direction back to the forwardmost position adjacent the barrel, a movement of the time delay unit to move the bolt engagement surface into the interfering position occurring at a time delay after movement of the bolt assembly back into the forwardmost position; and interconnecting the time delay unit with the secondary sear so that movement of the time delay unit in the first direction actuates the secondary sear to engage the hammer to retain the hammer from moving against the firing pin and so that movement of the time delay unit in the second direction actuates the secondary sear to release the hammer to cause the hammer to move against the firing pin after the time delay.

15. The method as set forth in claim 14 further comprising removing a sear trip surface from the bolt assembly and removing an interengaging sear trip from the secondary sear so that the trip surface is free of interengagement with the second sear throughout a full range of movement of the bolt assembly.

16. An automatic firearm comprising:

a frame;

a bolt carrier movably mounted in the frame including a bolt movably mounted in the bolt carrier;

a firing pin movably mounted in the bolt;

a hammer pivotally mounted in the frame constructed and arranged to move toward the firing pin when the bolt is in a forwardmost position, the hammer having a trigger sear shoulder and a secondary sear shoulder;

a trigger pivotally mounted in the frame and having a trigger sear that selectively engages a trigger sear shoulder;

a secondary sear constructed and arranged to engage the secondary sear shoulder at predetermined times to retain the hammer against movement toward the firing pin until the bolt is adjacent the forwardmost position;

a cam pivotally mounted in the frame and operatively connected to the secondary sear, the cam including an upper surface that is movable forwardly into and rearwardly out of a path of travel of the bolt carrier and the upper surface pivoting rearwardly in response to rearward movement of the bolt carrier and the cam including a shoulder for engaging the secondary sear in response to forward pivotal movement of the upper surface; and a time delay unit operatively connected with the cam, the time delay unit moving to a compressed position in response to a rearward pivotal movement of the upper surface and the time delay unit moving to an expanded position, thereby forwardly pivoting the upper surface into engagement with the sear at a predetermined delay time subsequent to a movement into the compressed position.

17. The automatic firearm as set forth in claim 16 further comprising a disconnector and a selector that operates the disconnector at a predetermined time wherein the disconnector engages the hammer to limit movement of the hammer toward the firing pin at predetermined times whereby semi-automatic fire is obtained.

18. The automatic firearm as set forth in claim 16 wherein the sear is constructed and arranged to engage the selector at predetermined times.

19. The automatic firearm as set forth in claim 16 wherein the frame comprises an M-16 family frame and wherein the bolt comprises an M-16 family bolt.

* * * * *